US006452142B2

(12) United States Patent
Eke

(10) Patent No.: US 6,452,142 B2
(45) Date of Patent: Sep. 17, 2002

(54) MICROWAVE OVENS AND SUB-ASSEMBLIES THEREFOR

(75) Inventor: Kenneth Ian Eke, Franklin, TN (US)

(73) Assignee: Apollo USA Inc., Franklin, TN (US)

( * ) Notice: Subject to any disclaimer, the term of this patent is extended or adjusted under 35 U.S.C. 154(b) by 0 days.

(21) Appl. No.: 09/773,114

(22) Filed: Jan. 31, 2001

Related U.S. Application Data

(60) Provisional application No. 60/179,791, filed on Feb. 2, 2000.

(51) Int. Cl.[7] ..... H05B 6/72; H05B 6/76

(52) U.S. Cl. ..... 219/746; 219/738; 219/748; 219/756; 174/35 R

(58) Field of Search ..... 219/746, 745, 219/748, 749, 750, 756, 736, 738, 741; 333/230, 231, 232; 174/35 R, 35 GL

(56) References Cited

U.S. PATENT DOCUMENTS 3,819,899 A * 6/1974 Wallin et al. ..... 219/738
4,350,859 A * 9/1982 Dudley et al. ..... 219/749
5,235,150 A * 8/1993 Buske et al. ..... 219/722
6,118,112 A * 9/2000 Osepchuk et al. ..... 219/749

FOREIGN PATENT DOCUMENTS

DE 1 127 520 * 4/1962 ..... 219/746

* cited by examiner

*Primary Examiner*—Philip H. Leung
(74) *Attorney, Agent, or Firm*—Lee, Mann, Smith, McWilliams, Sweeney & Ohlson

(57) ABSTRACT

A microwave oven has an oven cavity with a wall (2) formed with a hole (6) covered on an external side of the wall by a metal launch box (8) and choke plate (7). A metal match plate (10) is mounted on the internal side of the wall (2) so that the match plate (10) and the launch box (8) form a launch cavity for delivering microwave energy to the cavity. The choke plate (7) has a peripheral choke channel which prevents leakage of microwave energy between the launch box (8) and choke plate (7), enabling the choke plate (7) and match plate (10) to be bolted to the wall (2).

10 Claims, 9 Drawing Sheets

Figure 1:
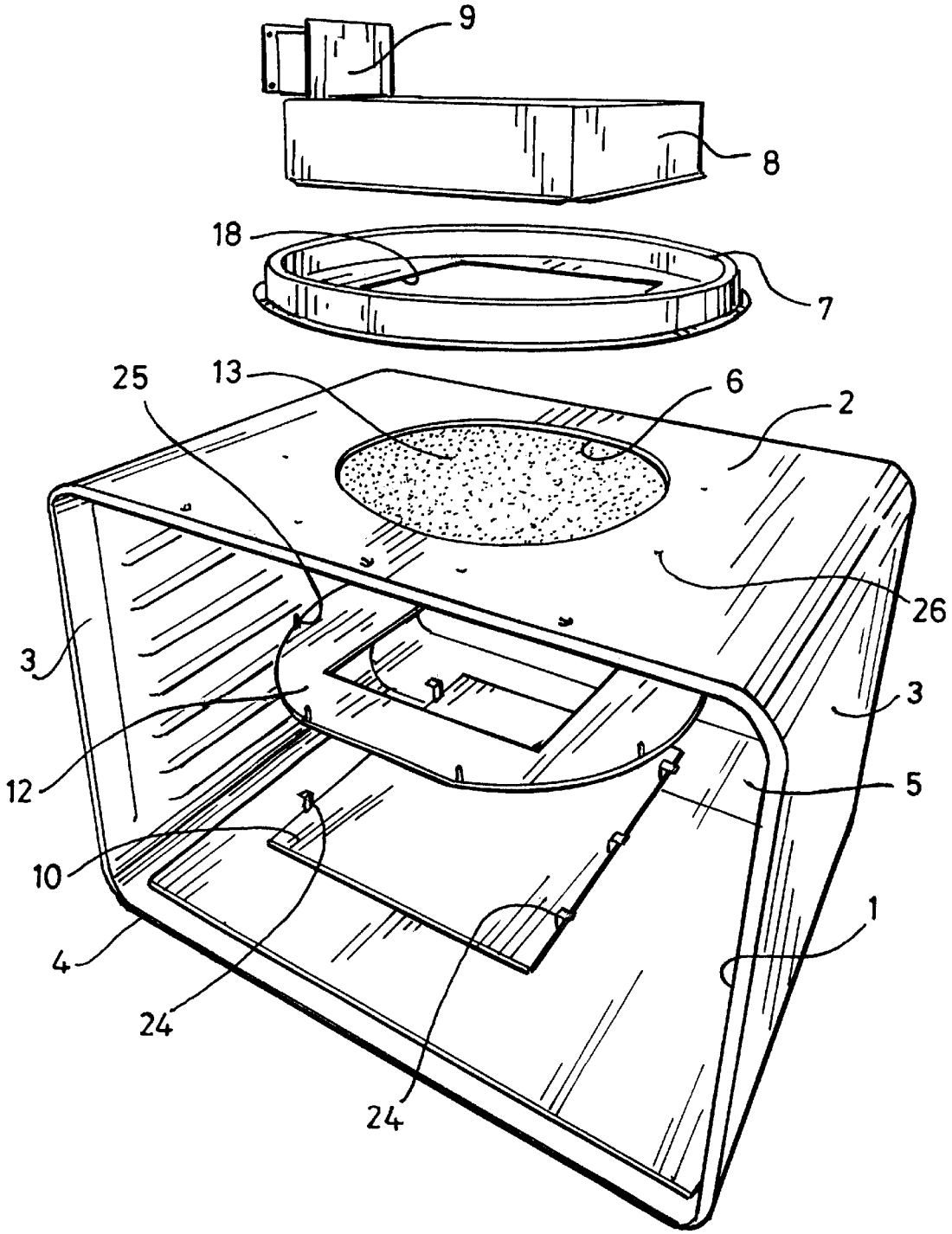

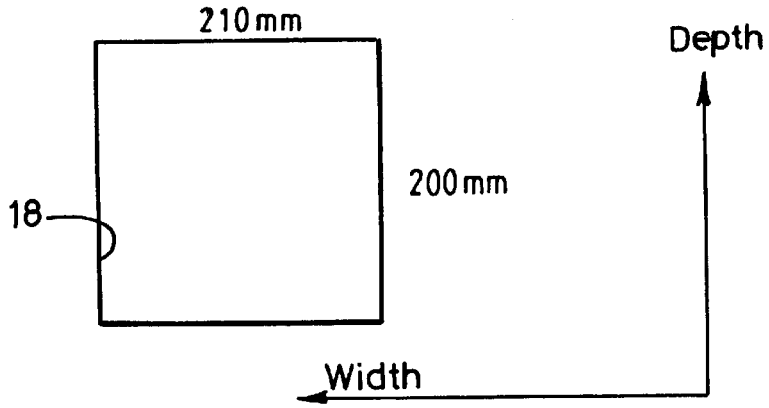
Fig. 11a
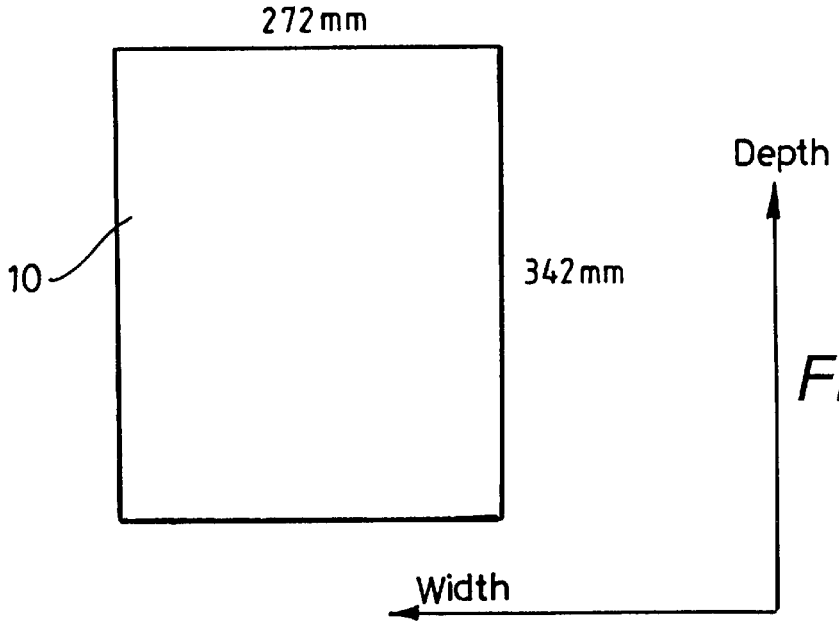
Fig. 11b
| | Width | Depth |
|---|---|---|
| X | 2 | 1 |
| □ | 5 | 5 |
| O | 6 | 3 |
| △ | 8 | 4 |
| ∝ | 9 | 3 |
| β | 9 | 1 |
Fig. 11c

MICROWAVE OVENS AND SUB-ASSEMBLIES THEREFOR

RELATED APPLICATION

This application is the non-provisional filing, and claims the benefit, of U.S. Provisional Patent Application No. 60/179,791 filed on Feb. 2, 2000.

This invention relates to microwave ovens and to sub-assemblies for fitting to oven cavities to form microwave ovens.

Reducing the sensitivity of microwave oven heating and cooking performance to load volume, load placement and load properties has been a longstanding challenge for microwave and microwave-convection oven designers.

One of the main reasons for this problem is the relatively direct coupling used between the magnetron source, a free-running oscillator, and the multimode oven cavity with its discrete spatial energy patterns. Each of these energy patterns can only be excited in an oven cavity at its distinct natural (or mode) frequency. That natural frequency is determined by the cavity geometry and dimensions and is modified dynamically by varying load (food and utensil) properties such as size, shape, composition and location within the oven.

To deliver power to the cavity, most microwave ovens employ a fixed feed or excitation system, (e.g., a waveguide) which results in effective power delivery to only those natural energy patterns which have their frequency and field orientation matched to that of the exciting field and which have their maximum field strength location near the feed structure. At the same time, the actual oscillator source (magnetron) frequency and power level is determined by the load impedance it sees. Significant downward or upward shifts in the oven's natural energy pattern frequencies occur when loading the oven with any dielectric or conducting material.

The invention aims to tackle these problems. The invention has been devised following theoretical and experimental work, as a result of which it has been found that certain components should have particular dimensions, or ranges of dimensions, to suit parameters such as the normal operating frequency of the magnetron which generates the microwave power. In the following description and claims all dimensions are given on the understanding that the tolerance is plus or minus 5%.

According to one aspect of the invention a launch box sub-assembly for fitting to the wall of an oven cavity comprises a metal launch box an open side of which is attached to a metal choke plate having a central launch or coupling aperture for communication with the oven cavity through a hole in the wall thereof, the choke plate being formed so as to prevent or substantially prevent leakage of microwave energy between the launch box sub-assembly and the wall of the oven cavity.

The launch box sub-assembly, together with a metal match plate and means for mounting the match plate within the oven cavity, preferably constitute a set of parts enabling an oven cavity, provided with the hole in one wall, to be made into a microwave oven, optionally with a forced hot air system for subjecting food in the oven cavity to heating by exposure to a forced flow of hot air in addition to exposure to microwave energy.

According to another aspect of the invention there is provided a pair of sub-assemblies for attachment to a wall of an oven cavity in order to form a microwave oven, the first sub-assembly comprising a metal launch box and choke plate for attachment to one side of the wall and the second sub-assembly comprising a metal match plate and mounting means for attaching the match plate on the other side of the wall so that the match plate cooperates with the wall to define a gap for delivering microwave energy to the oven cavity, the choke plate being shaped to prevent or substantially prevent leakage of microwave energy between the wall and the launch box and choke member.

According to a further aspect of the invention there is provided a microwave oven having an oven cavity with a wall formed with a hole covered on an external side of the wall by a metal launch box and choke plate, on an internal side of the wall and within the oven cavity there being fitted a metal match plate which faces the launch box through the hole so that the launch box and match plate form a launch cavity for delivering microwave energy to the oven cavity, the choke plate being shaped such that the periphery of the hole presents low impedance to prevent or substantially prevent leakage of microwave energy between the wall and the launch box and choke plate.

The choke plate preferably has an annular ridge or rib which defines a choke channel and the crest of which is formed by an annular wall which closes the end of the choke channel so as to ensure that this annular area is a zero power or low impedance area. Similar zero power conditions will apply at a distance from the annular wall of one half wavelength of the microwave energy. For a magnetron with an operating frequency of 2450 megahertz, this wavelength is 122 mm in free space, so by making the distance from the periphery of the hole to the center of the annular ridge or rib a distance of 61 mm, a zero power condition will apply around the complete periphery of the circular hole in the wall, a condition which will prevent the leakage of microwave energy between the wall and the launch box. This enables the launch box and choke plate to be attached to the wall by threaded studs and nuts or nuts and bolts, in a simple clamping action, in contrast to prior arrangements where welding has been necessary.

A waveguide is preferably attached to the launch box through a restricted aperture iris which decouples the magnetron from the load presented thereto by the launch box. The launch box preferably accommodates a rotatably driven frequency stirrer that operates as a phase modulator to change the phase angle of the load plane of the magnetron.

Thus, by recourse the invention, manufacturers can produce oven cavities with circular holes in any chosen wall (top, side or back), the circular hole being of known diameter. A circular shape of hole is preferred but in principle the hole could be of any chosen shape, for example polygonal or D-shaped. In each case, the choke channel surrounds the hole so that there is a distance of one half wavelength between the edge of the hole and the center of the choke channel. The launch box and waveguide can be separately welded to the choke plate to form a first sub-assembly. The match plate can be separately attached to the mounting means to form a second sub-assembly, and the two sub-assemblies can then be clamped in position on respective sides of the cavity wall, the sub-assemblies overlapping the hole.

According to a yet further aspect of the invention there is provided a microwave oven having an oven cavity with a wall formed with a hole covered on an external side of the wall by a metal launch box and choke plate, on an internal side of the wall and within the oven cavity there being fitted a metal match plate which faces the launch box through the hole so that the launch box and match plate form a launch cavity for delivering microwave energy to the oven cavity, the launch box having a width of 238 mm, a depth of 238 mm and a height of 56 mm, the match plate being mounted in a plane spaced from the plane of the wall by a distance of 20 mm, so that the launch cavity has a depth of 76 mm, which is equal to half the guide wavelength of the launch box.

In an additional aspect the invention provides a pair of sub-assemblies for attachment to a wall of an oven cavity in order to form a microwave oven, the first sub-assembly comprising a metal launch box and choke plate for attachment to one side of the wall and the second sub-assembly comprising a metal match plate and mounting means for attaching the match plate on the other side of the wall so that the match plate cooperates with the launch box to define a launch cavity for delivering microwave energy to the oven cavity, the launch box having a width of 238 mm, a depth of 238 mm and a height of 56 mm, the mounting means mounting the match plate in a plane spaced from the plane of the wall by a distance of 20 mm, so that the launch cavity has a depth of 76 mm. This arrangement ensures that the match plate and the facing panel of the launch box maintain their desired parallel relationship and desired spacing, even for a hot oven and after repeated heating and cooling.

The choke plate preferably has a rectangular launch or coupling aperture formed therein, preferably having a width of 210 mm and a depth of 200 mm, the match plate being mounted symmetrically below the launch or coupling aperture.

The match plate is preferably positioned and dimensioned to provide efficient microwave coupling to the oven cavity in a way which is independent of the extent of the food load in the cavity and the position of the food load in the cavity. The match plate acts as an over-sized non-contacting cover plate to provide cyclically time-varying edge coupling of energy via fringing and leaky-wave fields from the launch box to the oven cavity field patterns, through the gap defined between the edges of the match plate and the oven wall.

Thus, the first assembly acts as a transducer-exciter which isolates the magnetron from the oven cavity impedance, modulating the phase angle of the effective load plane of the magnetron and sets the preferred SWR (standing wave ratio) ranges which the magnetron tube will see. It also excites amplitude and phase modulated travelling waves along the perimeter of the match plate in a manner which significantly increases the opportunity for energy transfer from the launch box to the time and frequency varying energy patterns in the oven cavity.

One of the main practical advantages of the invention is that all kinds of metal utensils can be used in the oven cavity without sparking or arcing and without the food load being affected. It also allows for multiple shelf cooking with the same or different foods placed on any shelf, with all foods unaffected by the proximity or presence of any other food in the cavity.

The match plate is preferably rectangular, preferred dimensions being 272 mm wide by 342 mm deep for an oven cavity with a width of 609 mm, a depth of 457 mm and a height of 441 mm.

Figure 2:
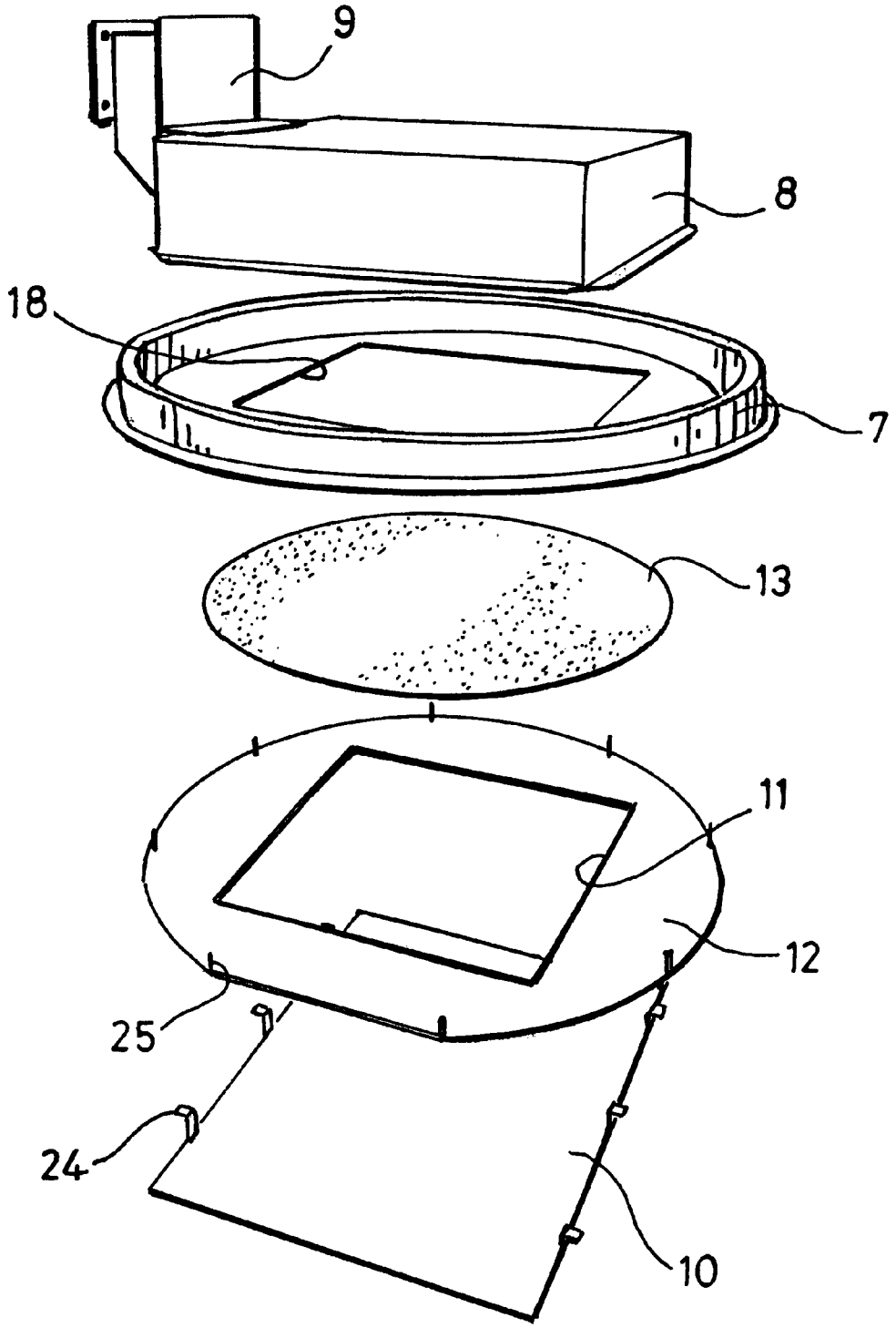
Figure 3:
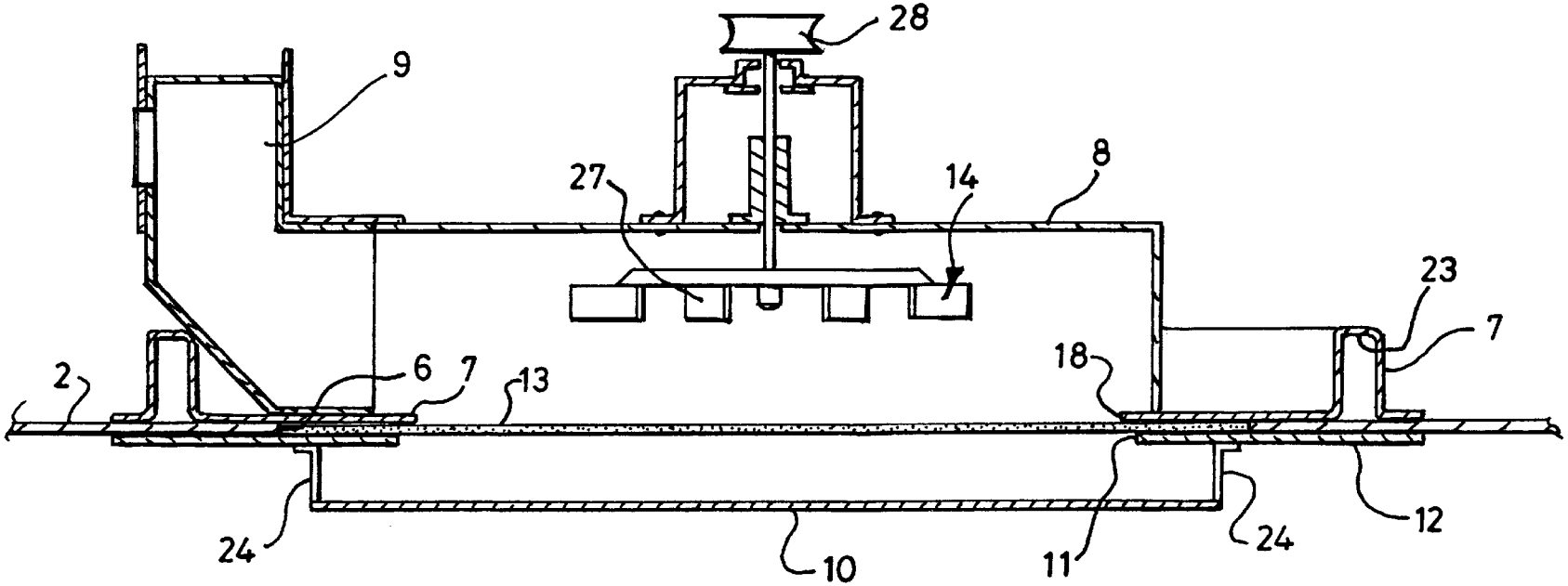
Figure 4:
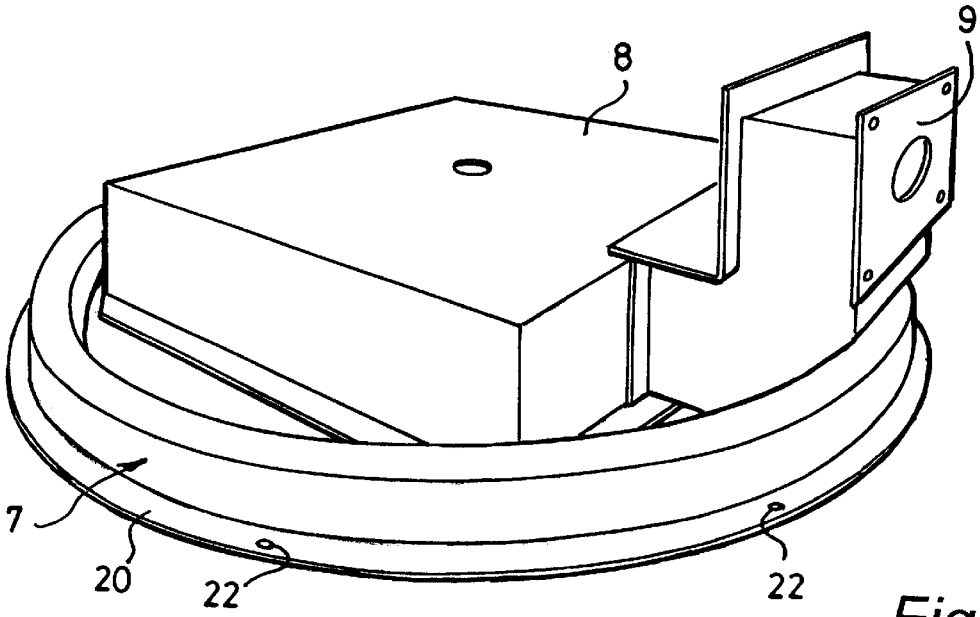
Figure 5:
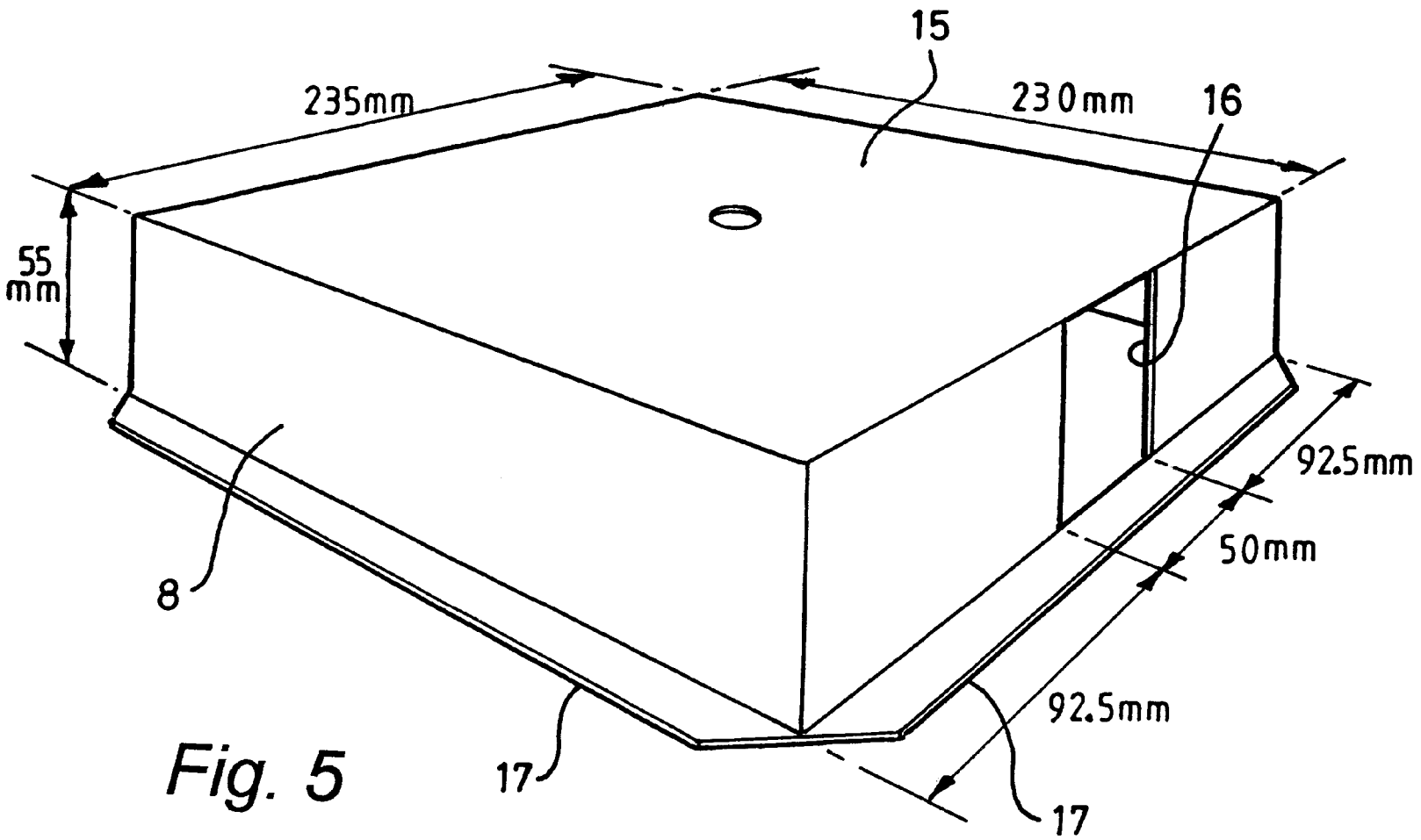
Figure 6:
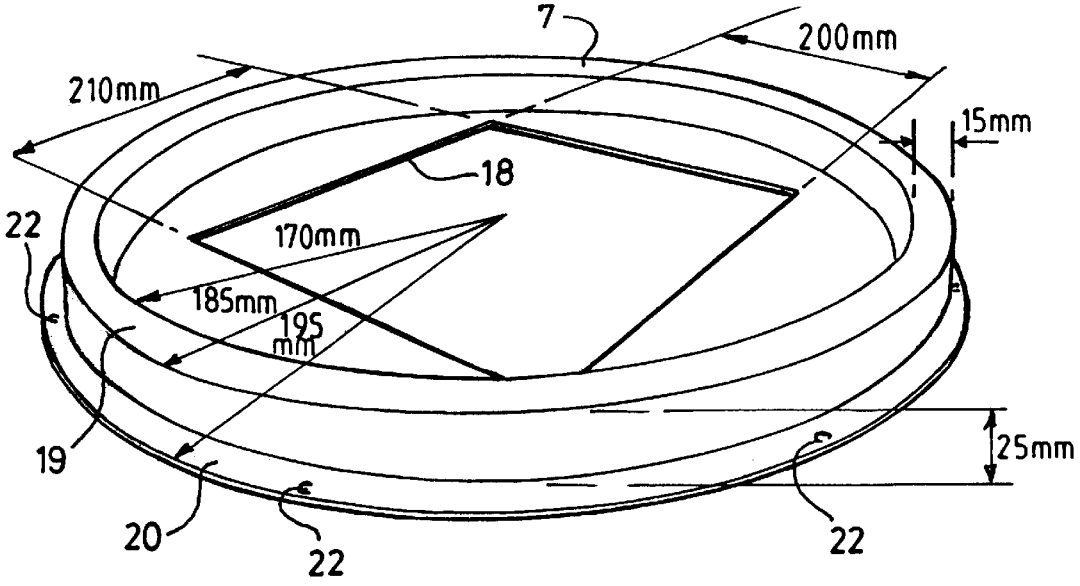
Figure 7:
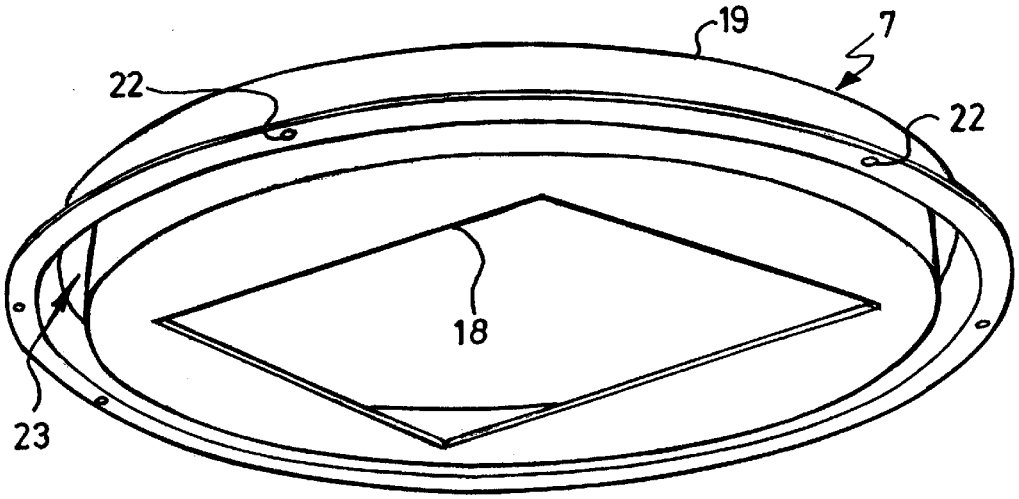
Figure 8:
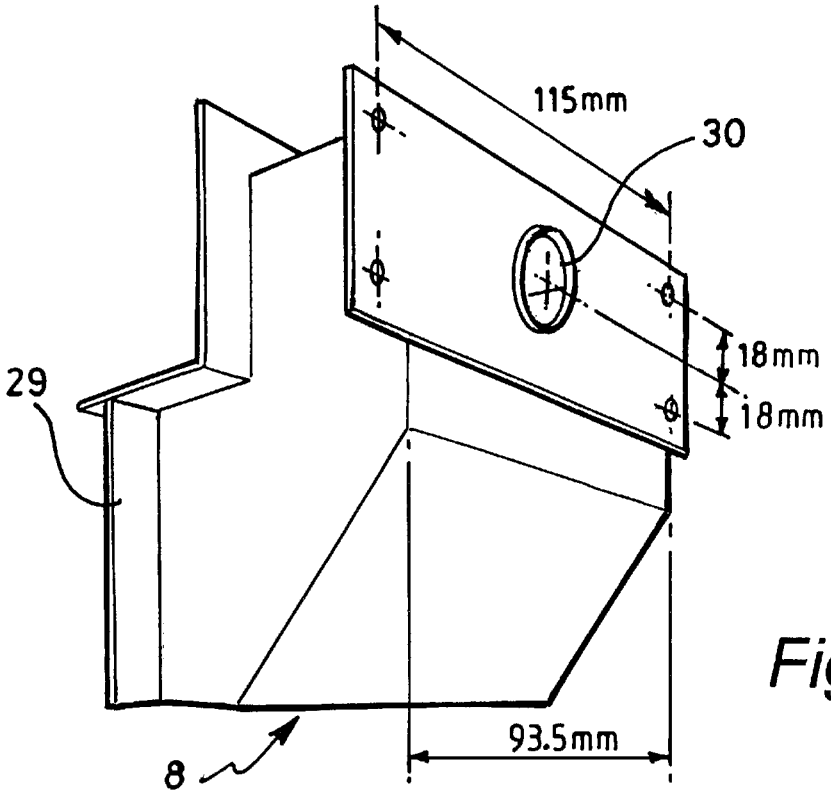
Figure 9:
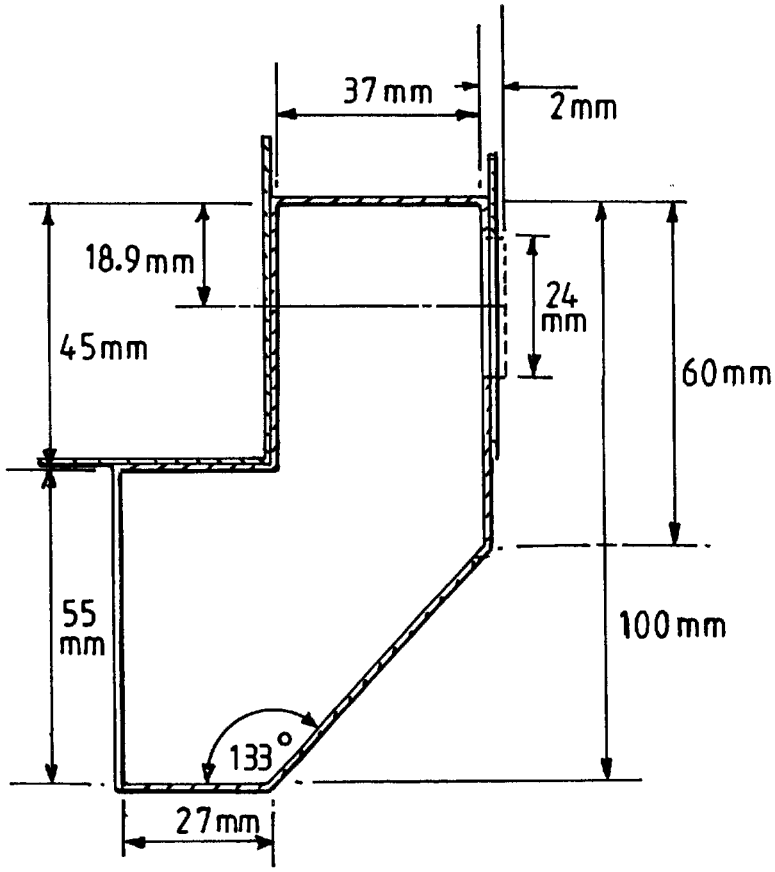
Figure 10:
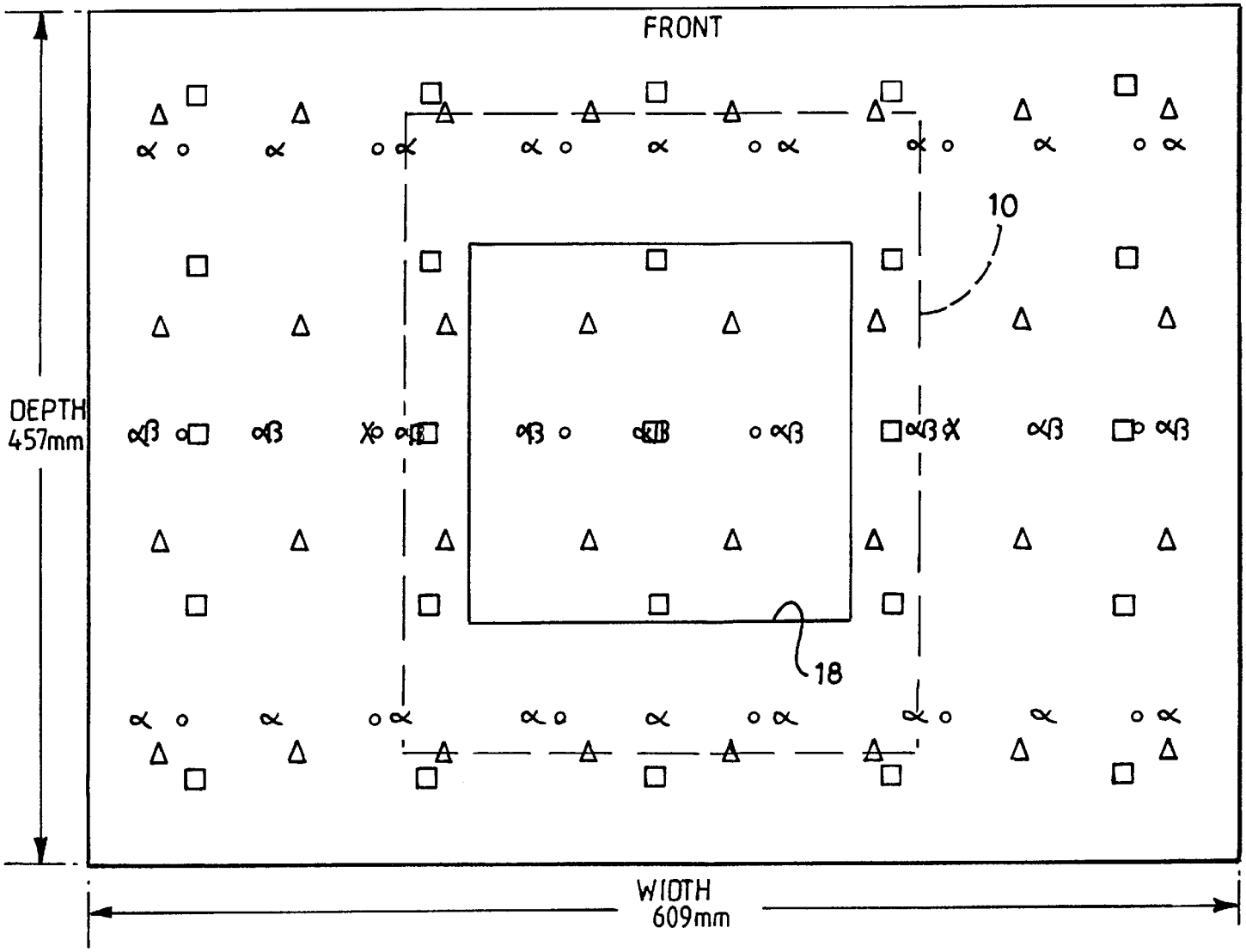

A microwave oven (for cooking foodstuffs) according to the invention will now be described, by way of example, with reference to the accompanying drawings, in which FIG. 1 shows the oven cavity, viewed from the front, with the components of two sub-assemblies in "exploded" view, FIG. 2 shows the components of the two sub-assemblies exploded, FIG. 3 is a sectional view through the top wall of the oven cavity with the two assemblies fitted, FIG. 4 illustrates a launch box sub-assembly, FIG. 5 illustrates a launch box of the sub-assembly of FIG. 4, FIGS. 6 and 7 show a choke plate of the sub-assembly of FIG. 4, FIG. 8 shows a waveguide of the sub-assembly of FIG. 4, FIG. 9 is a sectional view through the waveguide of FIG. 8, FIG. 10 is an underside view of a match plate showing the location of resonance modes, and FIG. 11*a* illustrates the dimensions of an aperture in the choke plate, FIG. 11*b* illustrates the dimensions of the match plate, and FIG. 11*c* is a table explaining the derivation of the resonant modes of FIG. 10.

Referring to FIG. 1, the oven cavity 1 is defined by a top wall 2, two side walls 3, a bottom wall 4 and a back wall 5. The front of the cavity is closable by a door (not shown) The top wall 2 has formed therein a central circular hole 6 having a radius of 145 mm. On the upper surface of the top wall 2 is attached a first sub-assembly comprising a circular metal choke plate 7, a metal launch box 8 and a metal waveguide 9 attached to one end of the launch box 8. A magnetron (not shown, the source of microwave energy) is attached to the waveguide 9. To the under-surface of the top wall is attached a second sub-assembly comprising a rectangular metal match plate 10 attached to mounting means in the form of a mounting frame 12. As can be seen from FIG. 2, the components to be fitted to the basic oven cavity include in addition a circular mica disc 13 of radius 145 mm which fits closely within the circular hole 6 in the top wall 2.

The components shown in FIG. 2 are attached to the top wall in the manner illustrated in FIG. 3 which additionally shows a rotatable frequency stirrer 14 within the launch box 8 and drive means for the frequency stirrer 14. In terms of influence on the magnetron, the frequency stirrer acts more as an impedance modulator than as a frequency stirrer.

The sub-assembly to be fitted to the upper surface of the top wall 2 is shown in FIG. 4. This upper sub-assembly comprises the launch box 8 best shown in FIG. 5. The launch box is rectangular in plan view, having a rectangular top panel 15 and four surrounding side panels one end panel of which has a central rectangular aperture 16 which is 50 mm wide to provide a restricted size iris through which microwave energy reaches the launch box 8 from the waveguide 9 (FIGS. 8 and 9). The launch box 8 has four out-turned flanges 17 which are welded to the central dished region of the choke plate 7 best shown in FIGS. 6 and 7.

Referring to FIGS. 6 and 7, the choke plate 7 has a rectangular central launch or coupling aperture 18 (width 210 mm and depth 200 mm) and, around its edge, has an upstanding annular rim 19 defining the shape of an inverted channel and an externally projecting attachment flange 20 provided with eight equi-angularly spaced holes 22 for attachment of the upper sub-assembly to the cavity wall 2. FIG. 7 shows the choke channel, the upper extent of which is closed by the annular wall 23 forming the top of the annular rim 19. The choke plate is made from metal 1.5 mm thick, the height of the rim 19 is 25 mm and the inner and outer radii of the rim 19 are 170 mm and 185 mm. The external radius of the flange 20 is 195 mm.

Turning now to the lower sub-assembly, the match plate 10 consists of a rectangular panel of metal 2 mm thick having a width of 272 mm and a depth of 342 mm. Along its longer edges, the match plate 10 has upwardly projecting legs 24 which are welded to the underside of the match plate mounting frame 12 from which project upwardly, at equi-angularly spaced positions, eight threaded studs 25 which register with eight holes 26 in the wall 2 and with the eight holes 22 in the outer flange 20 of the choke plate 7. The mounting frame 12 takes the form of a sheet of metal which is circular (radius 195 mm) but for a chordal flat at the front and a square aperture 11 with dimensions of 220 mm×220 mm.

The two sub-assemblies are attached to the cavity by passing the eight studs 25 through the holes 26 in the wall 2 and thence through the respective holes 22 in the choke plate flange 20, securing nuts then being screwed onto the projecting ends of the studs 25 so as to clamp the sub-assemblies firmly into position on the wall 2 of the oven cavity, in the manner illustrated in FIG. 3. The mica plate 13 is inserted between the two sub-assemblies so that the mica plate 13 is located in position within the circular hole 6 in the wall 2. The mica plate transmits microwave energy but prevents hot air reaching the launch box from the cavity, through which hot air may be circulated. The upper sub-assembly can occupy any one of four positions (separated by 90°) although it would not in practice occupy the position in which the wave guide 9 is at the front of the cavity.

Reverting to the upper sub-assembly, the use of only eight threaded studs 25 to clamp the upper sub-assembly onto the wall 2 would under normal circumstances give rise to the problem of leakage of microwave energy, but such leakage is prevented by the design of the choke plate 7. Theoretical considerations indicate that in order to stop leakage of microwave energy it is necessary to present a short-circuit condition at the point where microwave energy would otherwise escape, which in this case would be in the area of the circular hole 6 in the top wall 2 of the cavity. The required short-circuit condition is achieved by ensuring that the distance from the edge of the hole 6 to the central part of the annular shorting wall 23 of the choke channel is an integral number of quarters of a wavelength at the operating frequency of the magnetron producing the microwave energy. This wavelength is 122 mm and the distance between the periphery of the circular hole 6 and the center of the choke channel wall 23 is selected to be one half of a wavelength, i.e. about 61 mm. As a result of this dimensioning, the complete periphery of the circular hole 6 forms a zero voltage or short-circuit area so no leakage of microwave energy occurs between the wall 2 and the upper sub-assembly.

It is known that a metal box of certain dimensions can support a number of resonant modes, dependent on the frequency of resonance of the energising magnetron. The following equation governs the resonance modes:

$$f = \frac{c}{2}\sqrt{\left(\frac{L}{W}\right)^2 + \left(\frac{M}{D}\right)^2 + \left(\frac{N}{H}\right)^2}$$

Where f is the frequency of resonance c is the velocity of light

W, D and H are the width, depth and height dimensions of the box cavity

L, M and N are the corresponding numbers of resonant modes.

In this case, the oscillating frequency of the magnetron is 2455 megahertz plus or minus 20 megahertz.

By using the above formula and by relying on experiment, it has been found that a closed box having a width of 238 mm, a depth of 238 mm and a height of 76 mm gives mode patterns (i.e. values of L, M and N) of 211 and 121 over the operating frequency range of 2435 to 2475 megahertz. A mode pattern of 211 means that there are two resonances in the width dimension, one resonance in the depth dimension and one resonance in the height dimension. Similarly, a mode pattern of 121 means that there is one resonance in the width direction, two resonances in the depth dimension and one resonance in the height dimension. These resonances are formed by the variation of the primary electric field patterns with distance.

This advantageous combination of width, height and depth dimensions has been applied to the cavity defined between the launch box 8 and the match plate 10, it being appreciated that the depth dimension of the effective cavity is measured between the top panel 15 of the launch box 8 and the facing surface of the match plate 10. Thus, the match plate 10 occupies a plane parallel to the top panel 15 and spaced therefrom by 76 mm. The 20 mm gap between the match plate 10 and the wall 2 is in operation spanned by a decoupled wavefront. Microwave energy reaches the oven cavity through this gap around the edges of the match plate 10.

To accommodate the wide frequency range of 2435 to 2475 megahertz, the frequency stirrer 14 illustrated in FIG. 3 is employed. The frequency stirrer 14 comprises a rotor having metal blades 27 driven by a driveshaft and a drive pulley 28 which is in turn driven by an electric motor, optionally through a belt. The frequency stirrer 14 changes the phase angle of the load plane of the magnetron and sets the preferred standing wave ratio range which in turn sets the frequency of oscillation of the magnetron.

FIGS. 8 and 9 illustrate details of the wave guide 9 which is fabricated from metal and has flanges 29 welded to the launch box. A circular feed aperture 30 receives microwave energy from a magnetron (not shown).

The external size of the rectangular match plate 10 is determined in the following manner. The dimensions of the oven cavity (in this case width 609 mm, depth 457 mm and height 441 mm) are entered into the above equation for resonance, using the frequency range of 2435–2475 megahertz. From the computerised data, the modes that propagate within the 27 mode blocks are selected, these being:

| L | M | N |
|---|---|---|
| 2 | 1 | 7 |
| 5 | 5 | 4 |
| 6 | 3 | 5 |
| 8 | 4 | 2 |
| 9 | 3 | 1 |
| 9 | 1 | 3 |

This data is then onto the plane occupied by the match plate 10, to give the plot shown in FIG. 10 which is a view looking upwards on a plane just above the plate 10 and which depicts the modes or resonances by symbols explained in the table forming FIG. 11*c*. FIG. 11*c*, the first row means that there are 2 resonances marked by X in the width direction of FIG. 10 and one resonance marked by X in the depth direction of FIG. 10. The other rows of FIG. 11*c* have corresponding meanings. The size of the match plate 10 is chosen so that its edges are closest to the largest number of mode patterns. FIG. 11*a* shows the chosen dimensions (width 210 mm and depth 200 mm) of the rectangular launch or coupling aperture 18 in the choke plate 7. FIG. 11*b* shows the dimensions (width 272 mm and depth 342 mm) of the rectangular match plate 10.

The dimensions given herein are appropriate for a magnetron having an operating frequency of 2450 megahertz, which corresponds to a wavelength in free space of 122 mm. For other operating frequencies of the magnetron, the dimensions will require to be altered (in general, proportionately). For example, if the magnetron operating frequency is 896 megahertz or 915 megahertz, all dimensions will be reduced accordingly.

What is claimed is:

1. A set of parts for attachment to a wall of an oven cavity in order to form a microwave oven, the set of parts comprising a first sub-assembly, a second sub-assembly and a mica disc, the first sub-assembly comprising:

a metal launch box for receiving microwave energy from a magnetron;

an annular choke plate having a central rectangular aperture, the launch box being attached to the choke plate so as to cover the aperture on one side of the choke plate;

the choke plate having an annular ridge which defines a choke channel and the crest of which is formed by an end wall which closes the end of the choke channel, the ridge being surrounded by a peripheral outwardly projecting flange of the choke plate;

the second sub-assembly comprising:

a metal match plate carrying projecting legs;

a mounting frame to which the legs are attached so that the match plate is secured to the mounting frame in spaced parallel relationship thereto;

the mounting frame having a central rectangular aperture; and mounting means having nuts and cooperating threaded members for passing through holes in the wall and in the flange, the nuts being tightenable on the threaded members so as to clamp the flange and the mounting frame together with the wall therebetween, the launch box and choke plate being disposed on an external side of the wall and the match plate being disposed in the oven cavity at a position so that the match plate cooperates with the wall to define a gap for delivering microwave energy to the cavity, the closure of the choke channel by the annular end wall preventing or substantially preventing leakage of microwave energy between the choke plate and the oven wall, thereby enabling mechanical clamping by the mounting means to be used to attach the first and second sub-assemblies to the oven wall, the mica disc fitting within a hole in the oven wall and being retained in the hole in the oven wall by the choke plate and the mounting frame.

2. A set of parts according to claim 1, wherein the launch box has a width of 238 mm, a depth of 238 mm and a height of 56 mm, the mounting means mounting the match plate in a plane spaced from the plane of the wall by a distance of 20 mm.

3. A set of parts according to claim 1, wherein the central rectangular aperture in the choke plate has a width of 210 mm and a depth of 200 mm.

4. A microwave oven having an oven cavity with a wall formed with a hole, a first sub-assembly covering the hole on an external side of the wall, a second sub-assembly covering the hole on an internal side of the wall and within the oven cavity, the first sub-assembly comprising:

a metal launch box for receiving microwave energy from a magnetron;

an annular choke plate having a central rectangular aperture, the launch box being attached to the choke plate so as to cover the aperture on one side of the choke plate;

the choke plate having an annular ridge which defines a choke channel and the crest of which is formed by an annular end wall which closes the end of the choke channel, the ridge being surrounded by a peripheral outwardly projecting flange of the choke plate;

the second sub-assembly comprising:

a metal match plate carrying projecting legs;

a mounting frame to which the legs are attached so that the match plate is secured to the mounting frame in spaced parallel relationship thereto;

the mounting frame having a central rectangular aperture; and mounting means having nuts and cooperating threaded members passing through holes in the wall and in the flange, the nuts being tightened on the threaded members so as to clamp the flange and the mounting frame together with the wall therebetween, the launch box and choke plate being disposed on an external side of the wall and the match plate being disposed in the oven cavity at a position so that the match plate cooperates with the wall to define a gap for delivering microwave energy to the cavity, the closure of the choke channel by the annular end wall preventing or substantially preventing leakage of microwave energy between the choke plate and the oven wall, thereby enabling mechanical clamping by the mounting means to be used to attach the first and second sub-assemblies to the oven wall, and the oven having a mica disc fitting within a hole in the oven and being retained in the hole in the oven wall by the choke plate and the mounting frame.

5. A microwave oven according to claim 4, wherein the oven has a magnetron with an operating frequency of 2450 megahertz, the distance from the periphery of the hole to the center of the annular ridge or rib being 61 mm, so that a zero power condition applies around the complete periphery of the circular hole in the wall, a condition which prevents the leakage of microwave energy between the wall and the launch box.

6. A microwave oven according to claim 4, wherein a waveguide is attached to the launch box through a restricted aperture iris which decouples the magnetron from the load presented thereto by the launch box.

7. A microwave oven according to claim 4, wherein the launch box accommodates a rotatably driven frequency stirrer that operates as a phase modulator to change the phase angle of the load plane of the magnetron.

8. A microwave oven according to claim 4, wherein the launch box and match plate form a launch cavity for delivering microwave energy to the oven cavity, the launch box having a width of 238 mm, a depth of 238 mm and a height of 56 mm, the match plate being mounted in a plane spaced from the plane of the wall by a distance of 20 mm, so that the launch cavity has a depth of 76 mm.

9. A microwave oven according to claim 4, wherein the match plate is rectangular, being 272 mm wide by 342 mm deep for an oven cavity with a width of 609 mm, a depth of 457 mm and a height of 441 mm.

10. A microwave oven according to claim 4, wherein the aperture in the choke plate has a width of 210 mm and a depth of 200 mm.

* * * * *